US005678707A

United States Patent [19]

Stallbaumer et al.

[11] Patent Number: 5,678,707

[45] Date of Patent: Oct. 21, 1997

[54] MECHANISM FOR ROTATING A CRANE TURRET THROUGH A 500° ARC

[75] Inventors: Richard J. Stallbaumer, Overland Park, Kans.; Larry A. Matthes, Sibley, Mo.

[73] Assignee: Pioneer Engineering, Grandview, Mo.

[21] Appl. No.: 509,157

[22] Filed: Jul. 31, 1995

[51] Int. Cl.[6] ..... B66C 23/84

[52] U.S. Cl. ..... 212/253; 212/280; 191/12.2 R; 242/128; 414/918

[58] Field of Search ..... 191/12.2 R; 212/223, 212/230, 231, 238, 253, 261, 280, 349; 242/128, 397.1, 397.3; 414/918

[56] References Cited

U.S. PATENT DOCUMENTS

| | | | |
|---|---|---|---|
| 2,557,484 | 6/1951 | Wagner et al. | 212/280 |
| 2,903,145 | 9/1959 | Brinkel | 212/280 |
| 3,262,582 | 7/1966 | Pitman et al. . | |
| 4,064,997 | 12/1977 | Holland et al. | 212/280 |
| 4,793,203 | 12/1988 | Staggl | 414/918 |

*Primary Examiner*—Thomas J. Brahan

*Attorney, Agent, or Firm*—Hovey, Williams, Timmons & Collins

[57] ABSTRACT

A crane apparatus includes an upstanding mainframe and a boom unit that is supported for rotation on the mainframe through a range of movement of about 500°. The crane is provided with a plurality of fluid transmission lines having first ends fixed relative to the mainframe and second ends fixed relative to the boom unit. An elongated guide tube supports the lines relative to the boom unit and presents a lower end that is spaced radially from the axis of rotation of the boom unit for sweeping the lines along an arcuate path around the axis as the boom unit is rotated, coiling the lines beneath the guide element to inhibit kinking. This management of the lines reduces the amount of twisting per unit length of line and prevents kinking within the range of allowed movement of the boom unit.

9 Claims, 6 Drawing Sheets

MECHANISM FOR ROTATING A CRANE TURRET THROUGH A 500° ARC

BACKGROUND OF THE INVENTION

1. Field of the Invention

The present invention relates generally to rotatable cranes and, more particularly, to a truck-mounted crane having a boom unit that can be rotated through a 500° arc to enable use of the crane over both the front and back ends of the truck.

2. Discussion of the Prior Art

It is known to provide a truck-mounted crane having an upstanding mainframe secured to the truck frame, and a boom unit supported for rotation on the mainframe about a vertical axis. Hydraulic lines are secured between the hydraulic system of the mainframe and a pair of cylinder units of the boom unit to raise and lower the unit and to extend the outer booms typically provided. In addition, a line is provided for driving a winch connected to a cable suspended from the unit for lifting a load.

Because the lower ends of the hydraulic lines are fixed relative to the mainframe and the upper ends are fixed to the boom unit, they twist during rotation of the boom unit, resulting in kinking when the boom is rotated through an angle of as little as 200° in either direction from the home position over the rear of the truck. Thus, when moving a load from one side of the truck to the other, it is necessary to swing the load around the rear end of the truck since it is only possible to rotate the boom about 20° past the front of the truck in either direction.

It is possible to extend the range of rotation of the boom unit slightly by providing extra length in the hoses so that there will be more hose to twist, delaying kinking for several more degrees of rotation. However, high pressure hose of the type required for this application is expensive, and the longer the hoses, the greater the likelihood that they will become tangled and again kink, shutting off the flow of hydraulic fluid to the boom unit and disabling operation of the crane. In addition, even this extension in the range of movement of the boom unit is not enough to permit operation over the front of the truck through any appreciable range of movement without having to rotate loads around the rear of the truck.

On larger stationary cranes, it is known to provide a sealed coupling between the mainframe and the boom unit, and to provide sealed passages through the coupling so that hydraulic fluid can be transferred to the cylinder assemblies of the boom unit without requiring that the hydraulic lines between the mainframe and the coupling or between the coupling and the cylinder assemblies be twisted. However, such constructions are expensive and present the usual problems of sealing the coupling against leakage of high pressure fluid. Maintenance and repair of such known constructions is time consuming and expensive, and does not represent a practical solution for a relatively small truck-mounted crane adapted for heavy, constant field use.

OBJECTS AND SUMMARY OF THE INVENTION

It is an object of the present invention to provide a crane that overcomes the problems noted above with respect to prior truck-mounted crane constructions without adding the expense and maintenance requirements of a special swivel coupling between the mainframe and boom unit of the crane. By managing the hydraulic lines extending between the mainframe and the boom unit, it is possible to extend the range of rotational movement possible with the boom unit prior to kinking of the lines. Thus, a truck-mounted crane can be utilized not only over the rear end of the truck on which it is mounted, but over the front of the truck as well, increasing the utility of the crane significantly.

In accordance with these and other objects evident from the following description of a preferred embodiment of the invention, a crane apparatus is provided which includes an upstanding mainframe, a boom unit supported for rotation on the mainframe about a vertical axis, a drive means for driving rotation of the boom unit, and a plurality of fluid transmission lines having first ends fixed relative to the mainframe and second ends fixed relative to the boom unit. In addition, the apparatus includes an elongated guide element for supporting the lines relative to the boom unit. The guide element being rotatable with the boom unit and including a means for sweeping the lines along an arcuate path around the vertical axis as the boom unit is rotated, coiling the lines beneath the guide element to inhibit kinking.

By providing a construction in accordance with the present invention, numerous advantages are realized. For example, by managing the lines suspended between the boom unit and the mainframe in the manner noted, it is possible to spread twisting of each line along more of the length thereof, reducing the amount of twisting per unit length. Thus, kinking of each line is postponed until the boom unit has been rotated through up to an additional 50° of rotation or more in either direction relative to conventional truck-mounted cranes.

By freeing up the boom unit for rotation through a larger angle than is possible with existing truck-mounted cranes, it is possible to move loads from one side of the truck to the other around either the front or back of the truck rather than being forced to swing all loads around the back as with existing cranes. This increases the versatility of the crane when used on a truck, and permits use of the crane in many situations not feasible for prior art cranes.

BRIEF DESCRIPTION OF THE DRAWING FIGURES

The preferred embodiment of the invention is described in detail below with reference to the attached drawing figures, wherein.

DETAILED DESCRIPTION OF A PREFERRED EMBODIMENT

Figure 1:
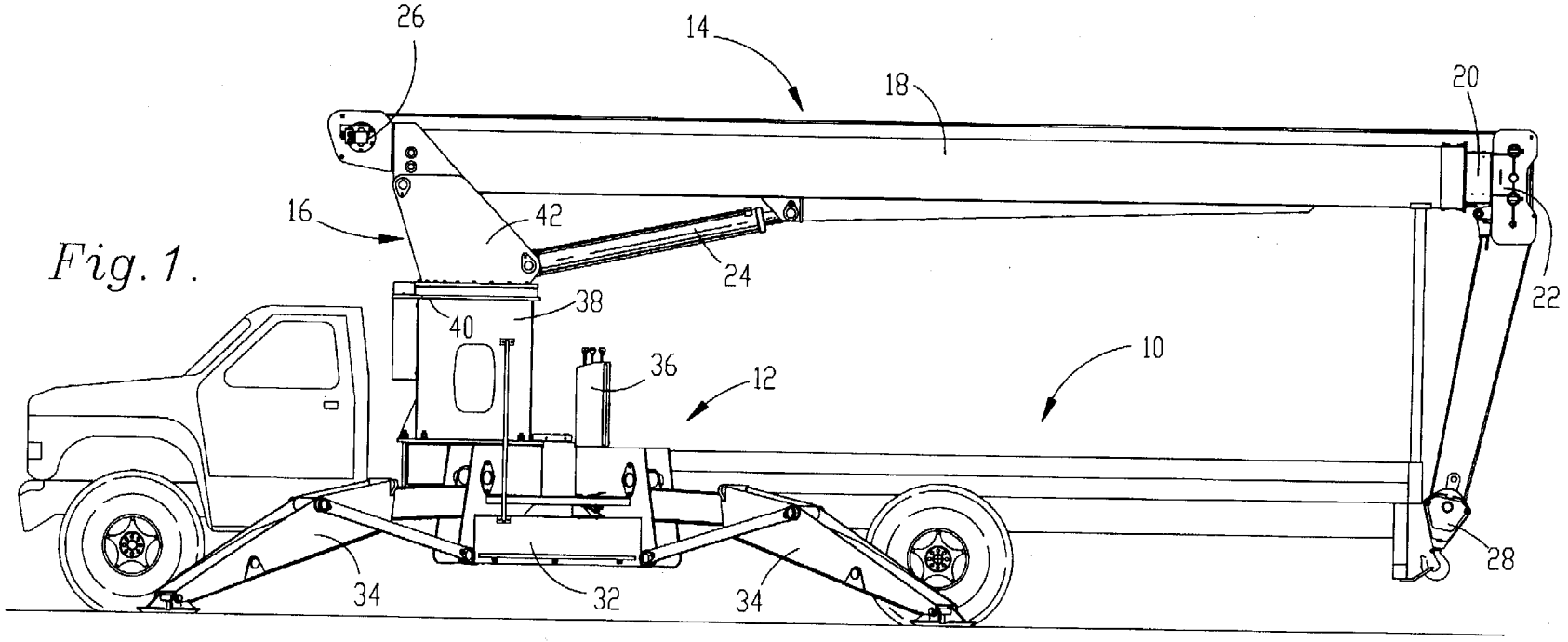
FIG. 1 is a side elevational view of a truck-mounted crane constructed in accordance with the preferred embodiment.

A truck-mounted crane constructed in accordance with the preferred embodiment of the present invention is illustrated in FIG. 1. The truck 10 is conventional, and includes an elongated frame extending between the front and rear wheels, and a cab over the front wheels.

The crane broadly includes a mainframe 12 secured to the frame of the truck, and a boom unit 14. The boom unit includes a turret 16 supported for rotation on the mainframe about a vertical axis, a base boom 18 supported for pivotal movement on the turret about a horizontal axis, and a pair of outer booms 20, 22 telescopically received in the base boom. A cylinder assembly 24 extends between the turret and the base boom for driving pivotal movement of the booms relative to the turret, and a second cylinder assembly is supported within the base boom and connected to the intermediate boom 20 for driving telescopic movement of the outer booms 20, 22. A winch 26 is mounted at the front end of the base boom and includes a line extending to the end of the outer boom 22 over a pulley for supporting a block 28 from the end of the boom.

Figure 3:
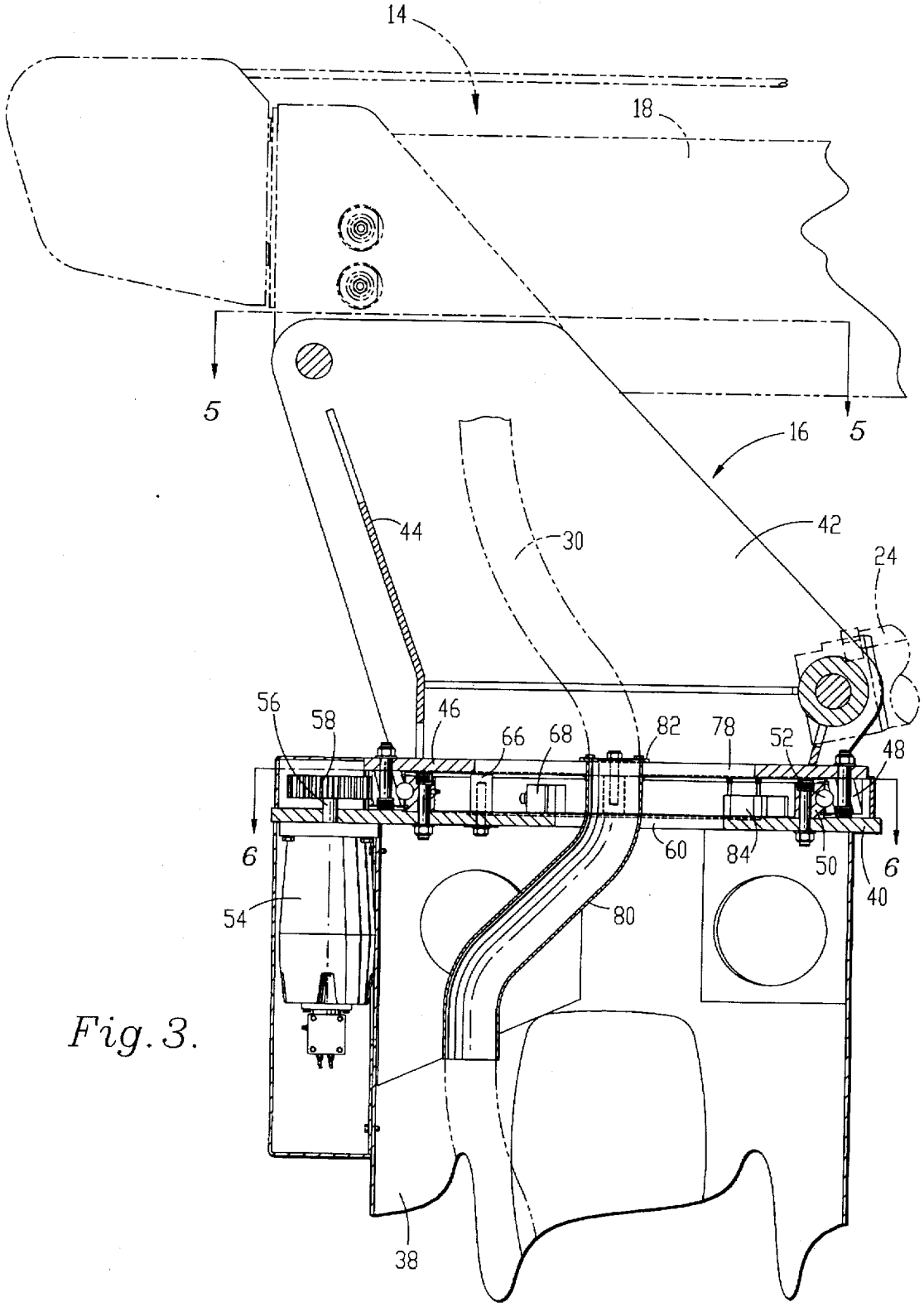
FIG. 3 is a fragmentary side sectional view of the crane, illustrating a turret of the boom unit and an upper end of a mainframe of the crane.
Figure 4:
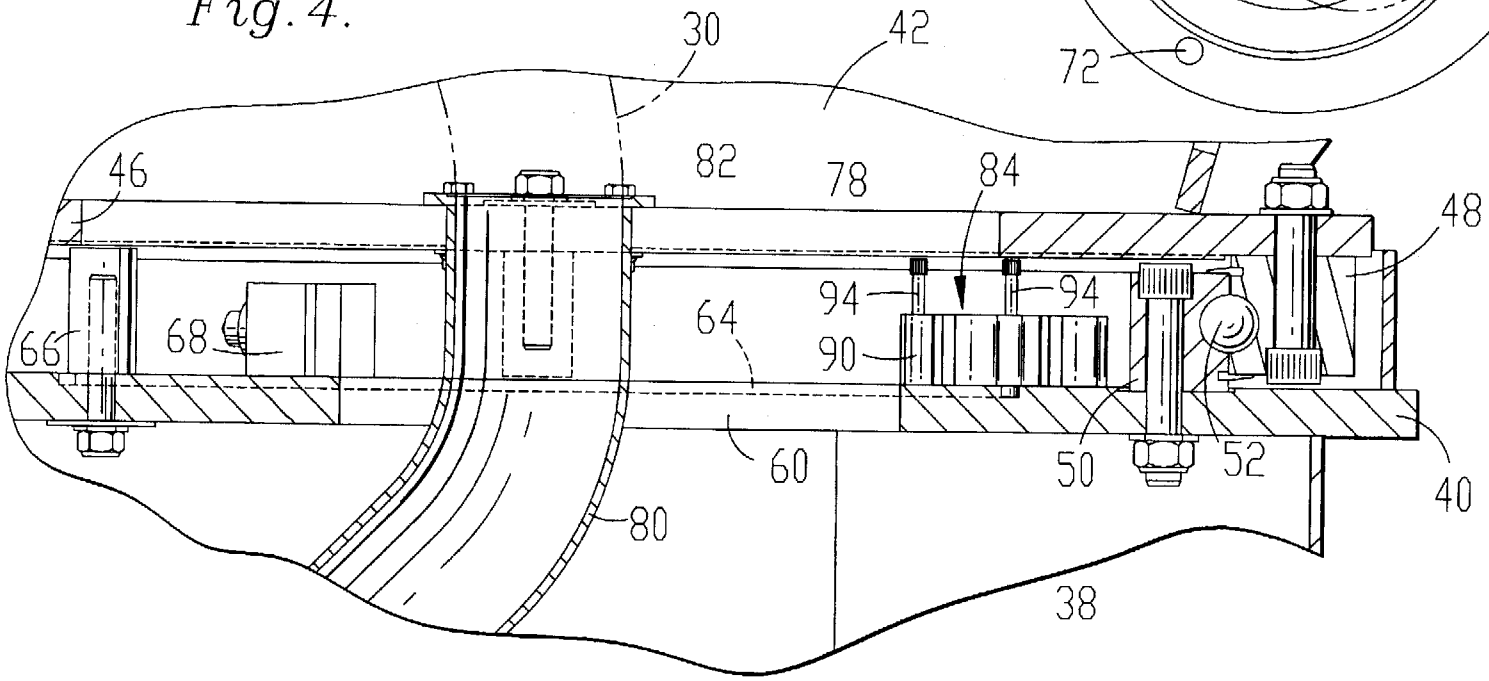
FIG. 4 is an enlarged fragmentary view taken from FIG. 3.

Hydraulic fluid is supplied to the cylinder assemblies and the winch by high-pressure hoses, designated collectively by phantom line 30 in FIGS. 3 and 4, extending between the mainframe and the boom unit. The hydraulic system on the truck is conventional, and includes a fluid reservoir, a pump for delivering the fluid under pressure to the boom unit, and valves associated with levers on the control station for permitting actuation of the cylinder assemblies and the winch from the platform of the mainframe. The lower ends of the high-pressure hoses are fixed relative to the mainframe and do not swivel when subjected to twisting. Likewise, the upper ends of the lines are fixed relative to the boom unit.

Figure 2:
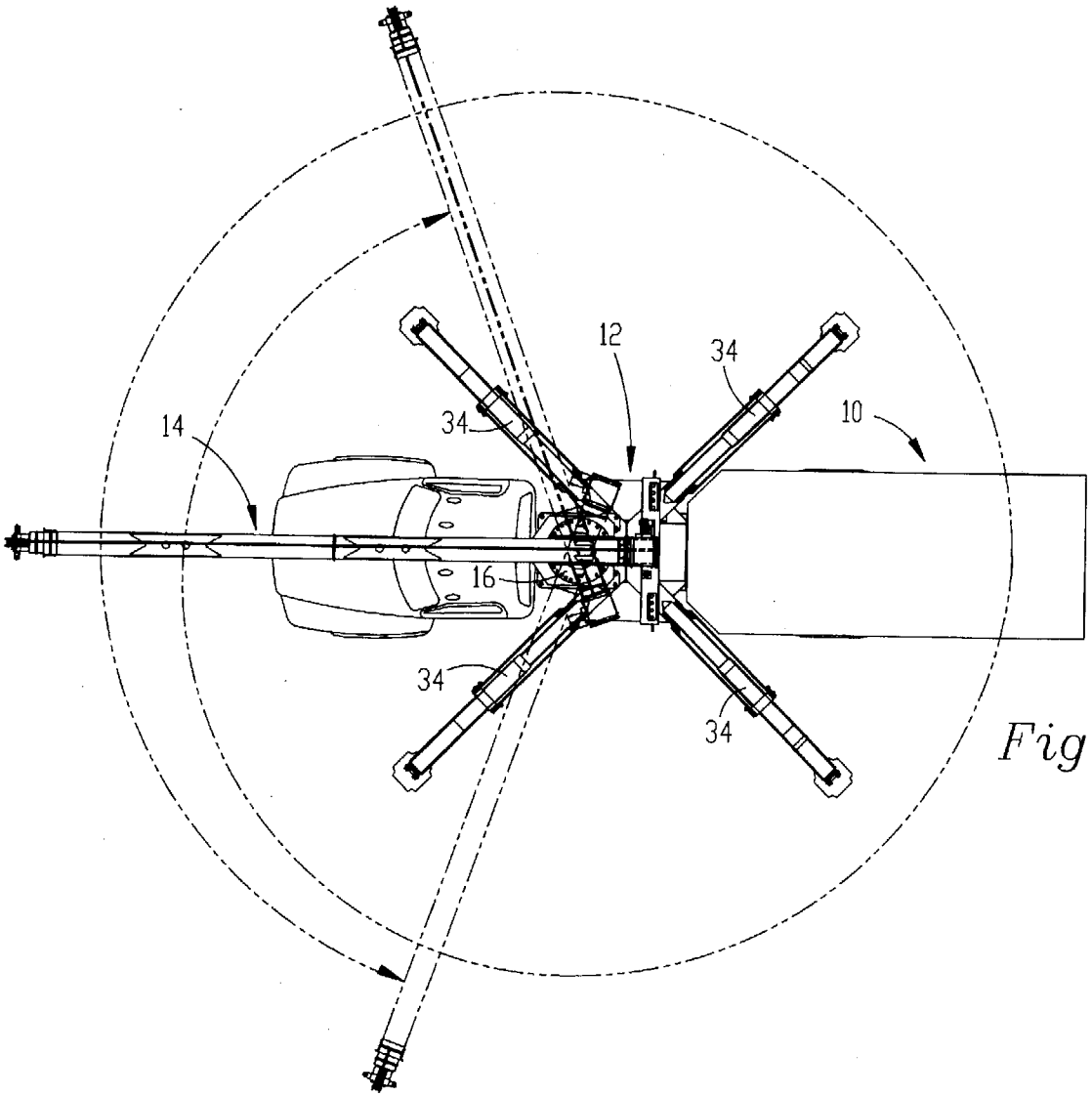
FIG. 2 is a top plan view of the crane, illustrating the range of rotation of a boom unit of the crane.

The mainframe 12 includes a weldment 32 that extends across the truck frame for securing the mainframe and the truck frame together. Four outrigger arm assemblies 34 are supported on the weldment and are movable between a raised storage position and a lowered, ground engaging position. As shown in FIG. 2, the outrigger arm assemblies are extended when lowered into engagement with the ground so that the points at which the arm assemblies engage the ground are generally aligned with the front and rear axles of the truck. A platform is defined on top of the weldment and includes a control station 36 at which an operator controls operation of the crane. Preferably, the control station is located centrally on the weldment so that it is accessible from either side of the turret. An upstanding tower extends upward from the platform and is spaced forward of the control station. The tower presents a plurality of side walls 38 and a top plate 40 on which the turret is supported.

As shown in FIG. 3, the turret of the boom unit includes a pair of laterally spaced side walls 42, a front wall 44, and a bottom plate 46. A shaft extends between and is connected to the side walls for supporting the cylinder assembly 24 and an upper shaft is provided for supporting the base boom 18 for pivotal movement relative to the turret. The bottom plate 46 opposes and is parallel to the top plate 40 of the mainframe, the two being generally horizontally disposed. A bearing assembly is provided between the plates for permitting relative rotation between the turret and the mainframe. The bearing assembly includes an outer race 48 secured to the bottom plate of the turret by suitable fasteners and an inner race 50 secured to the top plate of the mainframe by fasteners. Ball bearings 52 are housed between the inner and outer races and permit low-friction relative rotation between the races.

The outer race 48 of the bearing assembly is provided with gear teeth around the circumference thereof, and a drive motor 54 is supported on the mainframe for driving rotation of the turret. The drive motor is preferably a hydraulic motor, and includes an output shaft 56 and a gear 58 for engaging the outer race of the bearing assembly.

Figure 6:
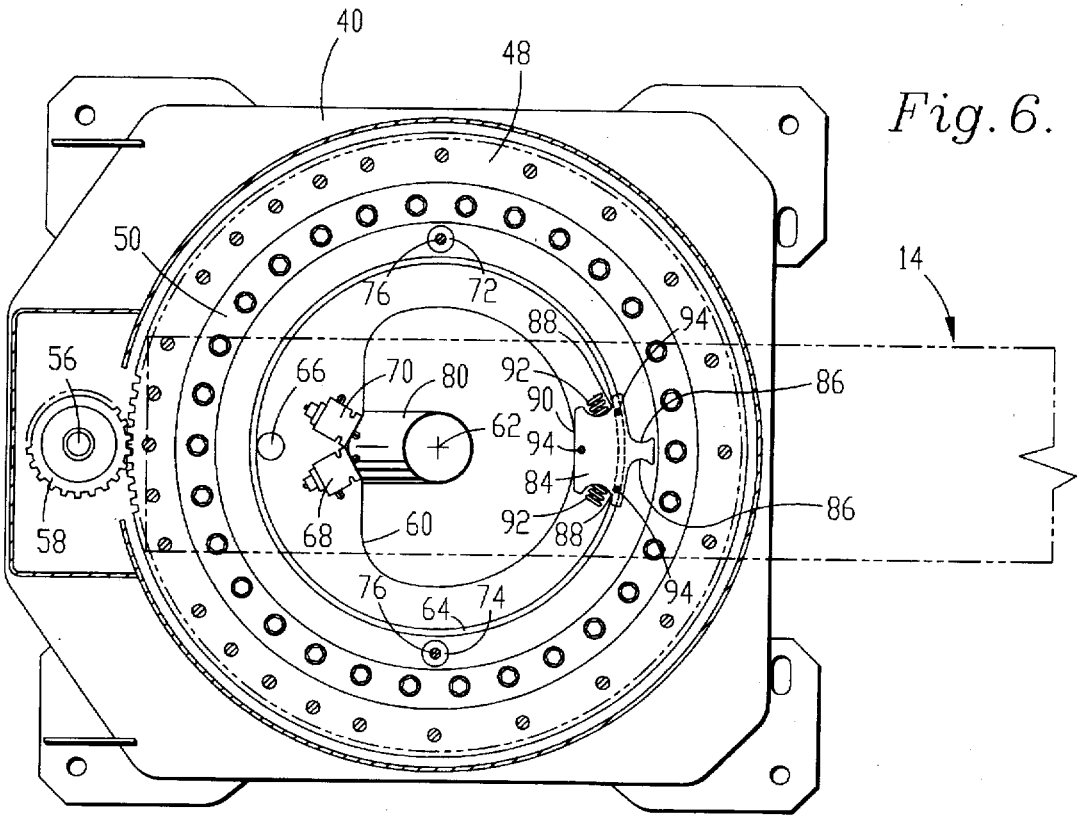
FIG. 6 is a sectional view taken along line 6—6 of FIG. 3.

As shown in FIG. 6, a kidney-shaped opening 60 extends through the top plate in alignment with the axis of rotation of the turret, designated by numeral 62, and a circular groove 64 is formed in the upper surface of the top plate coaxial with the axis. An upstanding pin 66 is secured to the top plate within the area circumscribed by the groove 64 and extends upward toward but not reaching the bottom plate 46 of the turret. This pin 66 remains fixed to the mainframe by a fastener during rotation of the turret. A pair of limit switches 68, 70 are secured to the top plate beside the opening, and each switch presents a button facing radially outward from the vertical axis. As discussed below, these limit switches define a sensing means for sensing when the boom unit has reached the limit stop at each end of its limited range of movement.

Figure 5:
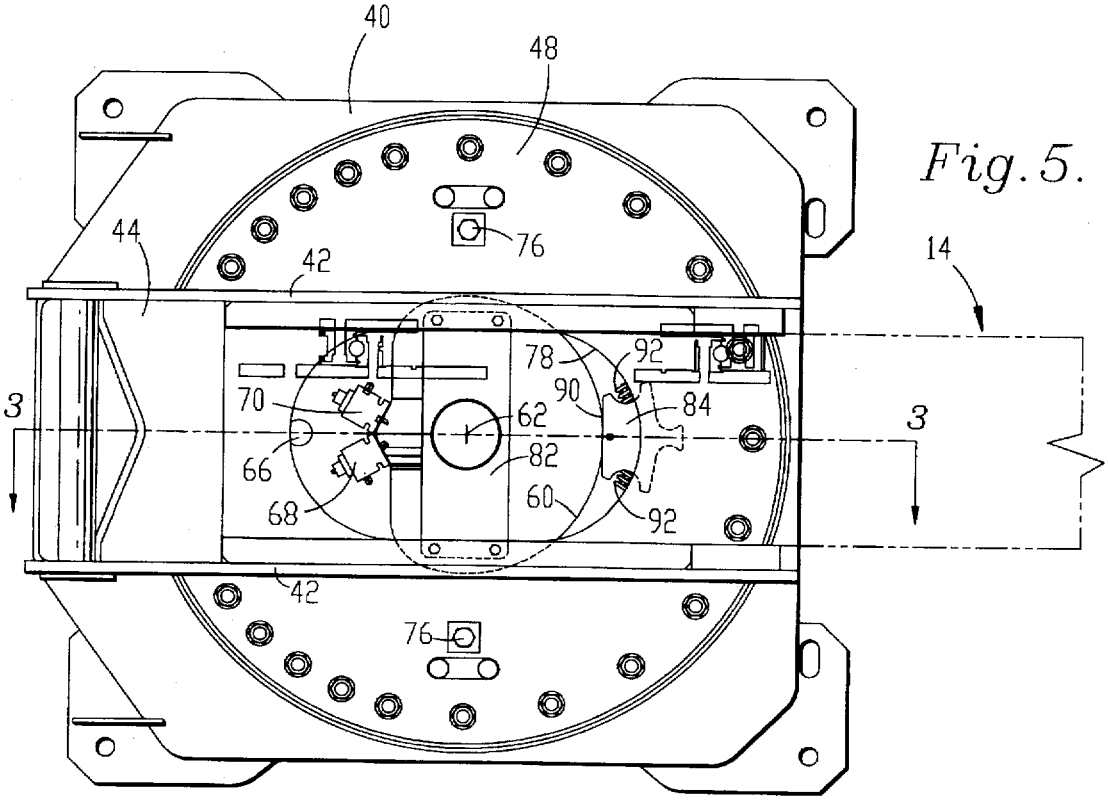
FIG. 5 is a sectional view taken along line 5—5 of FIG. 3.
Figures 7, 8:
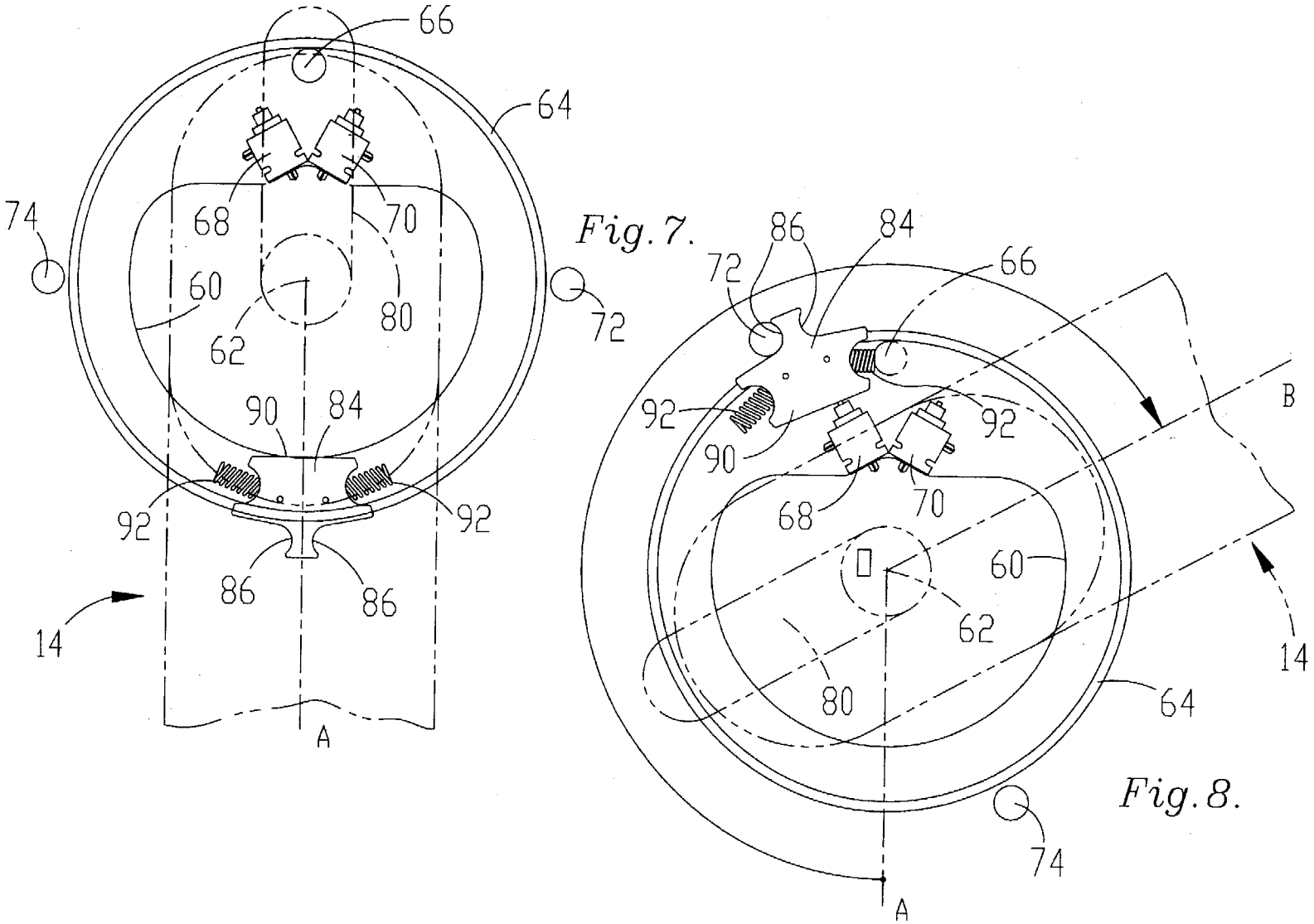
FIG. 7 is a schematic view similar to FIG. 6, illustrating the boom unit in a home position over the rear end of the truck.
FIG. 8 is a schematic view similar to FIG. 7, illustrating the boom unit during clockwise rotation relative to the mainframe.

The bottom plate of the turret is illustrated in FIG. 5, and includes an oval-shaped opening 78 in alignment with the axis of rotation, and a pair of diametrically opposed pins 72, 74, shown in FIG. 6, which are secured by fasteners 76 to the lower surface of the bottom plate and extend downward toward the top plate of the mainframe. As shown in FIG. 7, the major diameter of the opening 78 extends in a direction parallel to the length of the base boom 18, and the pins 72, 74 are disposed on opposite sides of the opening on a line extending transverse to the major diameter. The pins 72, 74 are disposed radially outside the area circumscribed by the groove 64 and remain fixed to the turret during rotation of the boom unit.

As shown in FIG. 3, an elongated guide element is secured to the bottom plate and extends downward through the openings 60, 78 for supporting the lines 30 relative to the boom unit. The guide element includes a serpentine-shaped tube 80 formed of a rigid material such as steel or the like, and a cross plate 82 connecting the tube to the bottom plate of the turret. As shown in FIG. 5, the cross plate extends across the opening 78 and supports the tube within the opening such that the upper end of the tube is flush with the opening and coaxial with the axis of rotation of the turret and the lower end of the tube is displaced radially from the axis by several inches. The guide element is rotatable with the boom unit, and sweeps the lines 30 along an arcuate path around the vertical axis as the boom unit is rotated, coiling the lines beneath the guide element to inhibit kinking.

As shown in FIG. 4, an intermediate force-transmitting member 84 referred to herein as a puck is supported within the groove 64 of the top wall of the mainframe for movement in a circular path defined by the groove. The puck is movable relative to both the mainframe and the boom unit, and extends radially of the vertical axis between the paths of movement of both the pin 66 and the pins 72, 74. As shown in FIG. 6, the puck 84 includes a first pair of opposed arcuate engagement surfaces 86 that are engaged by the pins 72, 74 of the turret when the boom unit is rotated so that the puck moves with the turret once one of the pins have been rotated into engagement with the puck. A second pair of opposed arcuate engagement surfaces 88 are formed in the puck which are shaped to receive the pin 66 of the mainframe when the puck is moved against the pin during rotation of the turret. Once the puck is sandwiched between the pin 66 and one of the pins 72, 74 of the turret, it prevents the turret from being rotated further in the same direction. This arrangement permits a range of movement of about 250° in either direction from a home position of the boom over the back of the truck, resulting in an overall range of movement of about 500° between the limit stops defined at each end of the range of movement.

The puck presents a cam surface 90 on the inner radial side of the puck relative to the axis of rotation 62. The cam surface 90 is oriented to engage and depress the buttons of the limit switches 68, 70 as the puck moves into engagement with the pin 66 of the mainframe. The limit switches 68, 70 are connected through a suitable electrical or hydraulic circuit to the hydraulic system for interrupting the supply of hydraulic fluid to the drive motor 54 when one of the buttons is depressed so that the motor is disabled from rotating the turret beyond the limit stop established by the pins 66, 72, 74 and the puck 84. Preferably, the puck is constructed to actuate each limit switch before the puck actually engages the pin 66 so that a soft stoppage of the boom unit rotation is achieved in both directions.

A pair of compression springs 92 are secured to the puck, each protruding from one of the arcuate engagement surfaces 88 so that the springs are interposed between the pin 66 and the engagement surfaces 88 of the puck. The springs 92 define a means for pushing the puck away from the pin 66 to release the buttons of the limit switches 68, 70 so that the drive motor 54 is enabled for bi-directional movement. Three elongated set screws 94 are provided on the puck for retaining the puck within the groove of the top plate and preventing the puck from coming free of the groove during normal operation. As shown in FIG. 4, the set screws extend upward from the puck toward the bottom wall of the turret and bump against the bottom wall if the puck is lifted, holding the puck in the groove and between the plates. In order to remove the puck, the set screws are threaded down into the puck by a distance sufficient to permit the puck to be slid from between the plates.

When the boom unit 14 is in the home or storage position over the back of the truck, as shown in FIG. 7, the pins 72, 74 on the bottom plate 46 of the turret are each spaced from the pin 66 of the mainframe by 90° about the vertical axis 62, and the puck 84 is spaced from the pin 66 on the opposite side of a line extending between the pins 72, 74. As the boom unit is rotated in a clockwise direction, as shown in FIG. 8, the pin 72 is swung into engagement with the puck, moving the puck along the groove in a circular path toward the pin 66 of the mainframe. As the puck 84 is moved against the pin 66, the cam surface 90 of the puck depresses the button of the limit switch 68, signaling the control circuit to disable the motor 54 from driving further rotation of the boom unit in the clockwise direction. Simultaneously, the spring 92 is depressed between the puck 84 and the pin 66.

Figure 9:
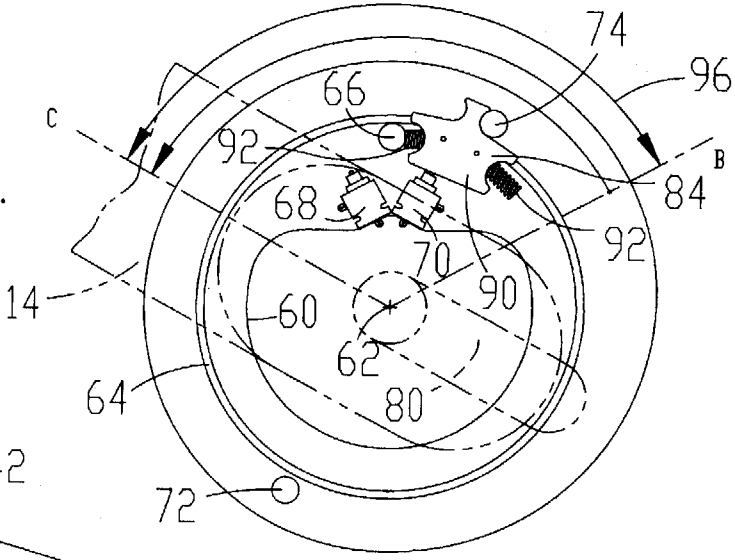
FIG. 9 is a schematic view similar to FIG. 7, illustrating the boom unit during counter-clockwise rotation relative to the mainframe.

When the boom unit is rotated back in a counter-clockwise direction from the position shown in FIG. 8, the spring pushes the puck from the pin 66 and the limit switch 68 so that it is again possible to drive the boom unit in either direction. When the boom unit is rotated further in the counter-clockwise direction, as shown in FIG. 9, the puck 84 is eventually engaged by the pin 74 and is moved in a circular path defined by the groove around the opening in the top plate and back toward the pin 66. Upon reaching the limit stop at the end of the limited range of movement defined by the pins 66, 72, 74 and the puck 84, the pin 66 is engaged by the spring 92 and the cam surface 90 depresses the button on the limit switch, signaling the control circuit to disable the motor from driving further rotation of the boom unit in the counter-clockwise direction. The total range of movement defined by the pins and the puck equals about 500°, and as shown by arrow 96 in FIG. 9, encompasses a range of about 140° over the front of the truck. As a result of this construction, it is possible to lift a load anywhere within the 140° region and to move the load within the region without having to swing the boom unit around the back end of the truck. Thus, a much larger working area is defined in front of the truck than is provided in conventional truck-mounted cranes.

As shown in FIGS. 7–9, the guide tube 80 rotates with the boom unit, supporting the hydraulic lines 30 extending between the mainframe and the boom unit and sweeping the lines along an arcuate path around the vertical axis 62 beneath the turret. This management of the hydraulic hoses prevents the hoses from twisting during rotation of the boom unit through the limited range of rotation defined by the pins and the puck. In order to visualize the advantage obtained through the use of the guide element, it is possible to consider a garden hose and the manner in which a garden hose will kink on itself when twisted about its axis. If, however, a garden hose is coiled on the ground, a similar number of twists can be made in the hose without causing kinking. This is the concept incorporated in the guide element of the present invention. The guide element prevents the hoses from kinking by keeping them from being subjected to a twisting force exerted along their axes during rotation of the boom unit.

Although the present invention has been described with reference to the preferred embodiment illustrated in the attached drawing figures, it is noted that substitutions may be made and equivalents employed herein without departing from the scope of the invention as recited in the claims.

What is claimed is:

1. A crane apparatus comprising:

an upstanding mainframe;

a boom unit supported for rotation on the mainframe about a vertical axis;

a drive means for driving rotation of the boom unit;

a control means for disabling the drive means from rotating the boom unit beyond a limited range of rotational movement, said control means including a sensing means for sensing the presence of the boom at the ends of the limited range of movement in each direction;

a circuit means responsive to the sensing means for disabling the drive means;

a first stop element supported on the mainframe;

a pair of second stop elements supported on the boom unit, the second stop elements being spaced radially from the first stop element and being spaced from one another relative to the vertical axis; and a puck supported between the mainframe and the boom unit and extending radially between the first and second stop elements, the second stop elements being engageable with the puck during rotation of the boom unit in either direction so that the puck is moved against the first stop element at the end of the range of movement of the boom unit, the puck actuating the sensing means prior to reaching the end of the range of movement so that the drive means is disabled.

2. A crane apparatus as set forth in claim 1 wherein is provided a plurality of fluid transmission lines having first ends fixed relative to the mainframe and second ends fixed relative to the boom unit, and an elongated guide element for supporting the lines relative to the boom unit, the guide element being rotatable with the boom unit and including a means for sweeping the lines along an arcuate path around the vertical axis as the boom unit is rotated, coiling the lines beneath the guide element to inhibit kinking.

3. A crane apparatus as recited in claim 2, wherein the guide element is supported on the boom unit and includes a rigid tube through which the lines extend, the tube presenting a lower end that is spaced radially from the vertical axis.

4. A crane apparatus as recited in claim 3, wherein the tube presents an upper end that is aligned with the vertical axis.

5. A crane apparatus as recited in claim 1, wherein the limited range of rotational movement is about 500°.

6. A crane apparatus as recited in claim 1, further comprising a track means for guiding movement of the puck about the vertical axis relative to both the mainframe and the boom unit.

7. A crane apparatus as recited in claim 1, further comprising a biasing means for biasing the puck away from the first stop element so that as the boom unit is rotated away from the end of the range of movement, the puck releases from the first stop element and the sensing means.

8. A crane apparatus as set forth in claim 1 wherein said pair of second stop elements are diametrically opposed to one another.

9. A crane apparatus comprising:

an upstanding mainframe;

a boom unit supported for rotation on the mainframe about a vertical axis;

a drive means for driving rotation of the boom unit;

a control means for disabling the drive means from rotating the boom unit beyond a limited range of rotational movement, said control means including a sensing means for sensing the presence of the boom at the ends of the limited range of movement in each direction;

a circuit means responsive to the sensing means for disabling the drive means;

a first stop element supported on the mainframe;

a second stop element supported on the boom unit, the second stop element being spaced radially from the first stop element; and a puck supported between the mainframe and the boom unit and extending radially between the first and second stop elements, the second stop element being engageable with the puck during rotation of the boom unit in either direction so that the puck is moved against the first stop element at the end of the range of movement of the boom unit, the puck actuating the sensing means prior to reaching the end of the range of movement so that the drive means is disabled.

* * * * *